US006264513B1

(12) United States Patent
Marsh

(10) Patent No.: US 6,264,513 B1
(45) Date of Patent: Jul. 24, 2001

(54) WIRELESS MARINE CONTROL SYSTEM

(76) Inventor: Gregory S. Marsh, 15135 Memorial Dr., Apartment 5109, Houston, TX (US) 77079

( * ) Notice: Subject to any disclaimer, the term of this patent is extended or adjusted under 35 U.S.C. 154(b) by 0 days.

(21) Appl. No.: 09/335,467

(22) Filed: Jun. 17, 1999

(51) Int. Cl.[7] ..... B63H 5/125
(52) U.S. Cl. ..... 440/53; 114/286; 440/61
(58) Field of Search ..... 440/53, 1, 2, 61, 440/40, 42; 114/343, 286, 284, 285, 287

(56) References Cited

U.S. PATENT DOCUMENTS 5,725,402 * 3/1998 Marsh ..... 440/53
5,894,810 * 4/1999 Orr ..... 114/343

* cited by examiner

*Primary Examiner*—Ed Swinehart
(74) *Attorney, Agent, or Firm*—Arthur M. Dula

(57) ABSTRACT

A wireless remote control system for extending the control functions of the electrically actuated control systems of a boat including a plurality of transmitters and receivers, each transmitter capable of generating a signal on two channels and receiver control responsive to each of the two signals and capable of synthesizing a third control signal from the combination of the two signals.

4 Claims, 4 Drawing Sheets

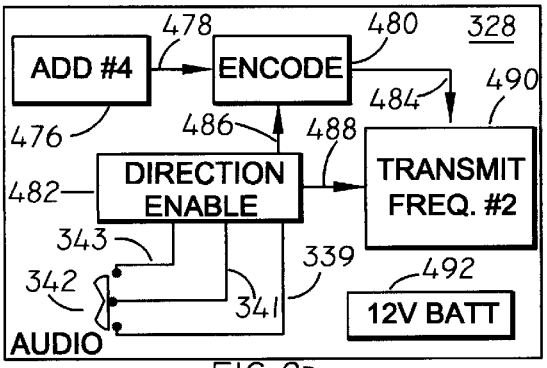
FIG.2D
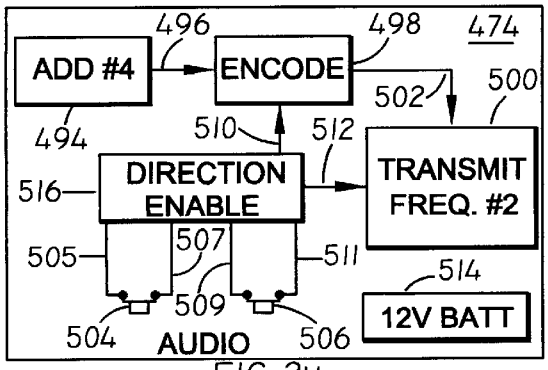
FIG.2H
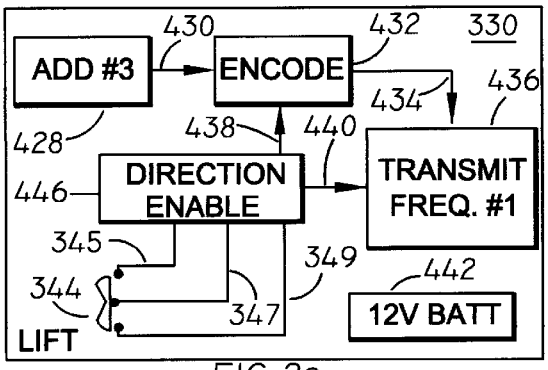
FIG.2C
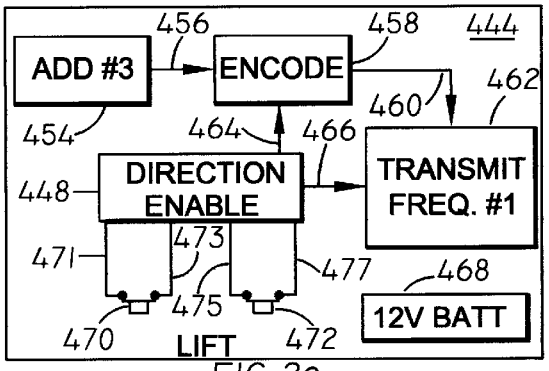
FIG.2G
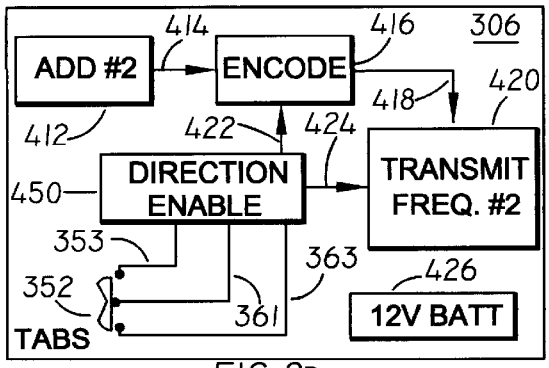
FIG.2B
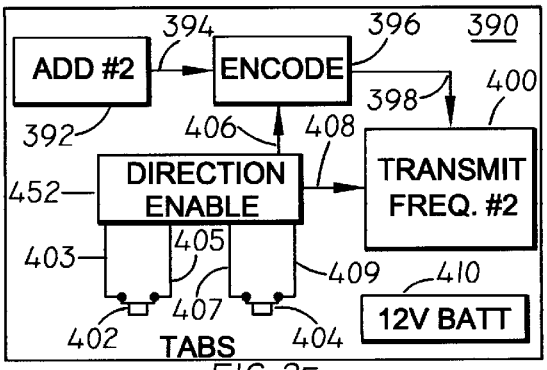
FIG.2F
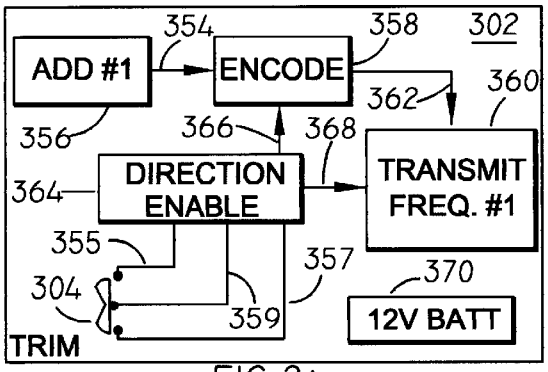
FIG.2A
STEERING WHEEL
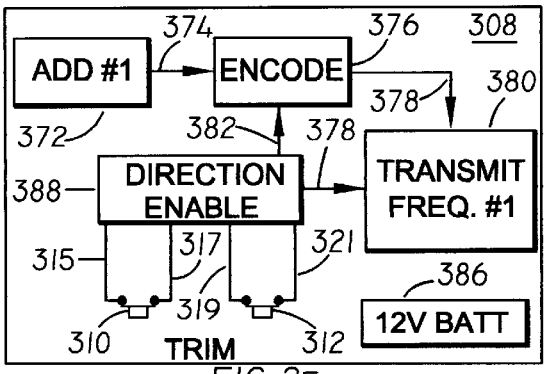
FIG.2E
KEY FOB
FIG.2

WIRELESS MARINE CONTROL SYSTEM

TECHNICAL FIELD

The present invention relates generally to the remote control of the functions of a boat's trim/tilt adjustments, engine lift, engine starter, audio system, and more particularly, to the wireless control of the these systems from a plurality of transmitters and receivers.

BACKGROUND OF THE INVENTION

Boats are provided with electrically actuated systems that allow the operator of the boat to control numerous functions of the boat and propulsion system. Due to design constraints, these controls are often placed in areas that are less than ideal ergonomically. The boat owner frequently adds additional systems after the boat is purchased and the controls for these systems are typically located in even less desirable locations.

My prior invention, U.S. Pat. No. 5,725,402 that issued on Mar. 10, 1998, discloses a wireless control system for boats. The present invention is an improvement over my prior invention.

In general, boats are provided with an electrically actuated means to adjust the angle at which the boat's hull rides in the water. These adjustments are commonly known as "trim" adjustments. Changes in water condition, passenger weight distribution, and boat speed require the operator to make these adjustments frequently to maintain optimum hull attitude for maximum efficiency, safety, and performance. Trim adjustments are accomplished by any of the following methods: moving the propulsion unit about an axis within a range of approximately −5 degrees to +20 degrees referenced to the boats transom; moving the jet pump's discharge nozzle about an axis; moving about an axis external hydrodynamic control surfaces affixed to the stem known as "trim tabs"; varying the depth of the propulsion unit in the water by moving it vertically.

The term "tilt" is used to describe the movement of the propulsion unit from the fully lowered position (−5 degrees) to the fully raised position of approximately +45 degrees. Tilt is used for raising and lowering the propulsion unit when the boat is entering or leaving the water, flushing the cooling system on land, transporting the boat on a trailer, and storing the boat.

A boat's engine is typically started by turning a key switch located on the dashboard. The key switch completes the electrical circuit that energizes the engine's ignition and starter motor. The wires and connection terminals to the key switch are usually exposed.

The audio systems used in boats typically consist of a stereo sound source connected to a separate audio power amplifier. The sound source is frequently an in-dash radio/cassette/audio disc player. The controls for the sound source are usually located some distance from the operator, normally on the dashboard in front of the passenger seat.

There are numerous problems with the type of controls taught by the prior art. The first problem is that the trim and tilt controls are located inside of the boat and are connected by wires to control electronics. These controls are usually push buttons. They are typically integrated into the throttle arm, attached to the steering wheel, or mounted on the dashboard. All of these locations are in the front of the boat. When the boat is sitting on its trailer and the operator uses the trim/tilt switches to lower the propulsion unit, it is necessary to stop frequently to walk back to the stem to see how far away from the ground the propulsion unit's skeg is. Misjudging the distance and tilting the unit into the ground will damage the skeg and propeller.

The second problem is that prior art makes it inconvenient and time consuming for the operator to remove the boat's cover after transporting to gain access to the trim and tilt controls to lower the propulsion unit prior to storage. Manufacturers of boats and propulsion units require the unit be stored in the fully lowered position to eliminate stress on the boat's transom and the hydraulic system of the propulsion unit's trim/tilt cylinders.

The third problem is that the prior art makes it difficult to attach any control switches (trim, tilt, trim tabs, jet discharge nozzle, engine lift, and audio control) to the boat's steering wheel where they can be safely and conveniently accessed by the operator's fingertips while the boat is underway. This is due to the requirement for a heavy water proof, usually coiled; wire that connects the control switches to the boat's dashboard. Such wire can become tangled during turns, especially at high speeds, and impair hand and steering wheel movement.

The fourth problem is the exposed terminals and wires on the boat's key switch are easily accessible under the dashboard. The easy access offers no deterrent to theft. Unauthorized persons can bypass the switch in a matter or seconds with a jumper wire and enable the ignition and activate the engine's starter.

The fifth problem is prior art makes it difficult for the boat operator to adjust the volume of the boat's audio system due to the distance between the location of the audio controls and the driver's position, and the inherent rough and unstable driving conditions experienced while underway.

The sixth problem is that when the boat is stationary in the water and the occupants are outside, prior art makes it difficult for them to control the volume of the boat's audio system due to control means utilizing signals that propagate line-of-sight. Additionally, the control device can not withstand exposure to water.

SUMMARY OF THE INVENTION

The present invention is a wireless remote control system using multiple waterproof transmitters that are mounted on the boat's steering wheel for use while the boat is underway and multiple waterproof transmitters that are carried by the boat operator to activate the boat's control systems from outside of the boat while the boat is stationary in the water or on land. The transmitter signals are received by multiple receivers located in the control unit that provides an electrical interface to the boat's control electronics responsive to push-button inputs to the transmitters.

The transmitters that are carried by the operator are a battery powered key fob design with two push-button switches. The enclosures are waterproof and are sealed by a gasket that incorporates the push-button actuators for the switches. Each transmitter output is encoded with a unique digital address and is capable of simultaneous transmission on two channels in response to inputs from the switches.

The transmitters that are mounted on the steering wheel are battery powered and designed to mount on the spoke of the wheel, placing the control switch at the thumb of the operator. The transmitter enclosures are mirror image pairs allowing multiple transmitters to be used on both sides of the steering wheel. The enclosures are waterproof and incorporate a momentary waterproof rocker switch. The back of the enclosure is gasketed and removable to allow access to the battery. Each transmitter output is encoded with a unique digital address and is capable of non-simultaneous transmission on two channels in response to inputs from the rocker switch.

ADVANTAGES OF THE INVENTION

One advantage of the present invention is that it allows the functions of the boat's control systems to extend to ergonomically correct locations on the steering wheel and controlled simultaneously, while keeping both hands on the wheel, without the requirement and inconvenience of wires.

Yet another advantage of the invention is that it provides a wireless means to control the functions of the boat's control systems from a location outside of the boat while the boat is stationary in the water or on dry land sitting on its trailer.

Another advantage of the present invention allows the propulsion unit's trim and tilt functions to be controlled by the boat's operator from the steering wheel while the boat is underway.

Yet another advantage of the present invention allows the propulsion unit to be raised and lowered without removing the boat's cover to access switch controls inside the boat by an operator standing at the stem where he may observe the propulsion unit's position to ensure that it does not strike the ground or other obstacles.

Another advantage of the present invention provides a wireless remote control means from the boat's steering wheel and from outside of the boat to control any marine propulsion unit that utilizes an electrically actuated jet pump discharge nozzle.

Another advantage of the present invention provides a wireless remote control means from the steering wheel and from outside of the boat to operate an electrically controlled outboard engine lifting device known as a "stem lift". The stem lift elevates the propulsion unit vertically and works in conjunction with trim to minimize drag without employing a high trim angle that will cause instability.

Yet another advantage of the present invention provides a wireless remote control means from the steering wheel and from outside of the boat to operate electrically controlled stem mounted "trim tabs".

Another advantage of the present invention provides a wireless remote control means from the steering wheel and from outside of the boat to control the volume of the boat's audio system.

Another advantage of the present invention provides a remote control means from outside of the boat to disable the boat's electrical system to deter theft.

Yet another advantage of the present invention provides a remote control means to control the supply of electrical current to any device onboard, typically a security alarm system, security illumination, or audio system.

BRIEF DESCRIPTION OF THE DRAWINGS

FIGS. 2*a*–2*d* are block diagrams showing the functional elements of the steering wheel mounted transmitters.

FIGS. 2*c*–2*h* are block diagrams showing the functional elements of the hand held key fob transmitters.

DESCRIPTION OF THE PREFERRED EMBODIMENT

Figure 1:
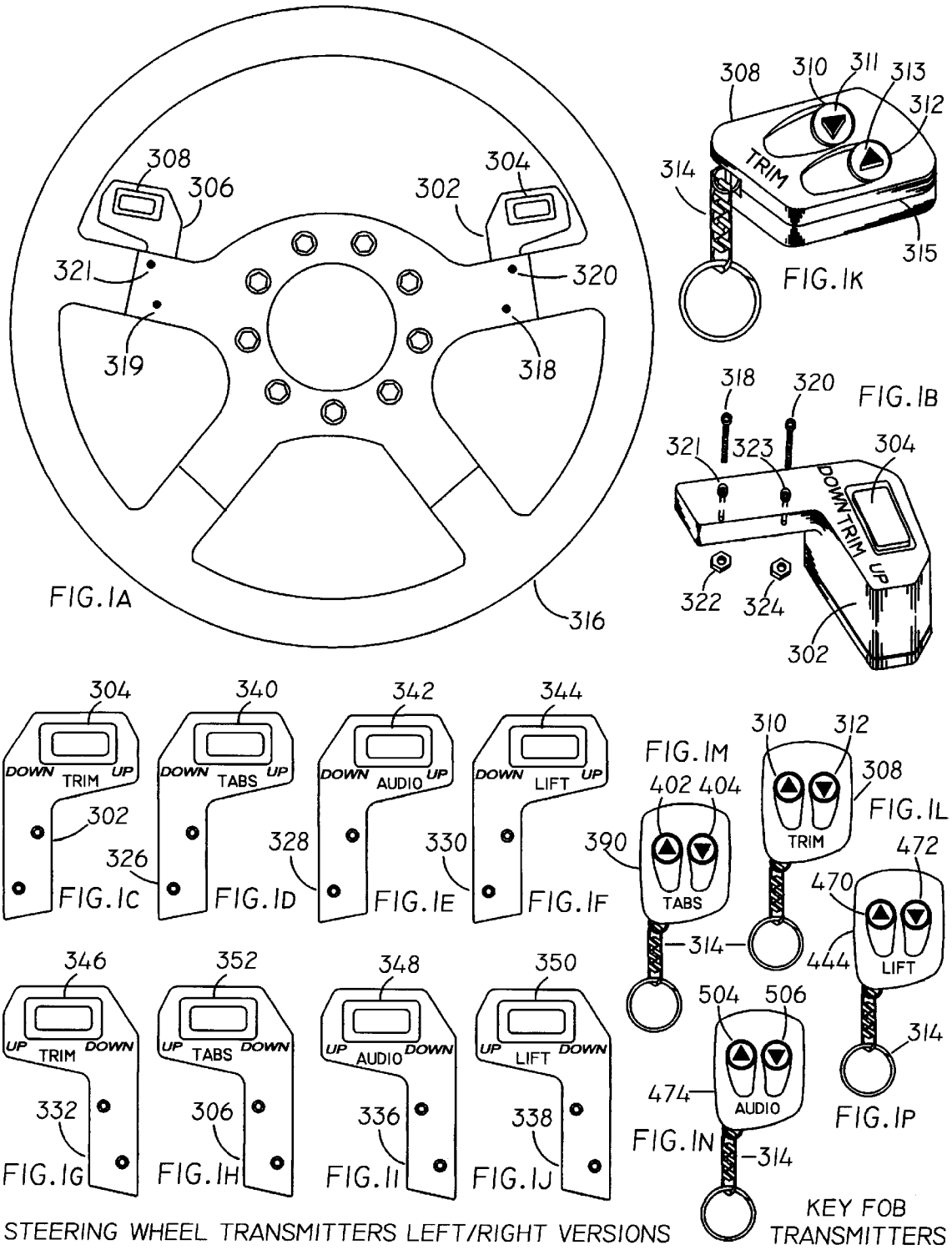
FIG. 1*a* shows the steering wheel transmitters of the preferred embodiment of the present invention in right and left hand applications mounted on the steering wheel.
FIG. 1*b* is a perspective view of a steering wheel transmitter.
FIGS. 1*c*–1*f* are front views of the right hand application of the steering wheel mounted transmitters.
FIGS. 1*g*–1*j* are front views of the left hand application of the steering wheel mounted transmitters.
FIG. 1*k* is a perspective view of a key fob hand held transmitter.
FIGS. 1*l*–1*p* are front views of the key fob hand held transmitters.

In FIG. 1*a*, remote transmitter 302 is attached to steering wheel 316 with screws 320 and 318 in a position convenient to allow the operation of rocker switch 304 while the operator of the boat is holding wheel 316 with the right hand. Likewise, remote transmitter 306 is attached to steering wheel 316 with screws 321 and 319 in a position convenient to allow the operation of rocker switch 308 by the operator's left hand.

FIG. 1*b* shows a perspective view of remote transmitter 302. Waterproof rocker switch 304 is mounted in the case of 302. Mounting screws 318 and 320 pass through holes 321 and 323 respectively. Nuts 322 and 324 attach to screws 318 and 320.

FIGS. 1*c*–1*f* are front views of the steering wheel mounted transmitters shaped for right-handed operation. Transmitter 302 and switch 304 are adapted electrically to control the "Trim" function of a boat's propulsion unit. Transmitter 326 and switch 340 are adapted electrically to control the "Tabs" function of a boat. Transmitter 328 and switch 342 are adapted electrically to control the "Audio" volume of the stereo system of a boat. Transmitter 330 and switch 344 being adapted electrically to control the "Lift" of an elevation device of a boat's propulsion system.

FIGS. 1*g*–1*j* are front views of the wheel-mounted transmitters shaped for left-handed operation. Transmitter 332 and switch 346 are adapted electrically to control the "Trim" function of a boat's propulsion unit. Transmitter 306 and switch 352 are adapted electrically to control the "Tabs" function of a boat. Transmitter 336 and switch 348 are adapted electrically to control the "Audio" volume of the stereo system of a boat. Transmitter 338 and switch 350 are adapted electrically to control the "Lift" of the elevation device of a boat's propulsion system.

FIG. 1*k* shows a perspective view of remote handheld key fob transmitter 308. Switch actuator 311 covers switch 310 (not visible) and forms a seal with the plastic case of transmitter 308 preventing water from entering. Likewise, switch actuator 313 covers switch 312 (not visible). Switch actuators 311 and 312 are part of the gasket (not visible) that forms a seal between the top and bottom case halves at 315. Keychain 314 is connected to transmitter 308.

FIG. 11 shows a front view of remote hand held key fob transmitter 308, switches 310 and 312 (not visible) and the attachment of keychain 314. FIG. 1*m* shows a front view of remote hand held key fob transmitter 390, switches 402 and 404 (not visible) and the attachment of keychain 314. FIG. 1*n* shows a front view of remote hand held key fob transmitter 474, switches 504 and 506 (not visible) and the attachment of keychain 314. FIG. 1*p* shows a front view of remote hand held key fob transmitter 444, switches 470 and 472 (not visible) and the attachment of keychain 314.

In FIG. 2*a*, block 302 contains the elements of waterproof steering wheel transmitter 302. Block 302 is designated to control the "Trim" functions of a marine propulsion unit. Momentary waterproof rocker switch 304 is connected to block 364 with wires 355, 359, and 357. Block 364 contains steering diodes responsive to contact closures on switch 304 that produce an enable signal on wire 368 connected to block 360 and a direction signal on wire 366 connected to block 358. Block 356 contains a digital address that is unique to block 302 in FIG. 2*a*, block 308 in FIG. 2*e*, and block 50 in FIG. 3. Block 356 provides the digital address on wire 354 which is connected to block 358. Block 358 encodes the digital address from block 356 and the direction signal from block 364. The encoded output of block 358 is connected by wire 362 to block 360. Block 360 is a wireless transmitter operating on frequency #1. Battery 370 provides +12 volts to the electrical elements of block 302.

In FIG. 2*b*, block 306 contains the elements of waterproof steering wheel transmitter 306. Block 306 is designated to control the "TABS" functions of a boat. Momentary waterproof rocker switch 352 is connected to block 450 with wires 353, 361, and 363. Block 450 contains steering diodes responsive contact closures on switch 352 that produce an enable signal on wire 424 connected to block 420 and a direction signal on wire 422 connected to block 416. Block 412 contains a digital address that is unique to block 306 in FIG. 2*b*, block 390 in FIG. 2*f*, and block 61 in FIG. 3. Block 412 provides the digital address on wire 414 which is connected to block 416. Block 416 encodes the digital address from block 412 and the direction signal from block 450. The encoded output of block 416 is connected by wire 418 to block 420. Block 420 is a wireless transmitter operating on frequency #2. Battery 426 provides 12 volts to the electrical elements of block 306.

In FIG. 2*c*, block 330 contains the elements of waterproof steering wheel transmitter 330. Block 330 is designated to control the "Lift" functions of a marine propulsion unit. Momentary waterproof rocker switch 344 is connected to block 446 with wires 345, 347, and 349. Block 446 contains steering diodes responsive to contact closures on switch 344 that produce an enable signal on wire 440 connected to block 436 and a direction signal on wire 438 connected to block 432. Block 428 contains a digital address that is unique to block 330 in FIG. 2*c*, block 444 in FIG. 2*g*, and block 55 in FIG. 3. Block 428 provides the digital address on wire 430 which is connected to block 432. Block 432 encodes the digital address from block 428 and the direction signal from block 446. The encoded output of block 432 is connected by wire 434 to block 436. Block 436 is a wireless transmitter operating on frequency #1. Battery 442 provides +12 volts to the electrical elements of block 330.

In FIG. 2*d*, block 328 contains the elements of waterproof steering wheel transmitter 328. Block 328 is designated to control the "Audio" volume functions of a boat's audio system. Momentary waterproof rocker switch 342 is connected to block 482 with wires 343, 341, and 339. Block 482 contains steering diodes responsive to contact closures on switch 342 that produce an enable signal on wire 488 connected to block 490 and a direction signal on wire 486 connected to block 480. Block 476 contains a digital address that is unique to block 328 in FIG. 2*d*, block 474 in FIG. 2*h*, and block 11 in FIG. 3. Block 476 provides the digital address on wire 478 which is connected to block 480. Block 480 encodes the digital address from block 476 and the direction signal from block 482. The encoded output of block 480 is connected by wire 484 to block 490. Block 490 is a wireless transmitter operating on frequency #2. Battery 492 provides +12 volts to the electrical elements of block 328.

In FIG. 2*e*, block 308 contains the elements of waterproof handheld key fob transmitter 308. Block 308 is designated to control the "Trim" functions of a boat's propulsion unit. Momentary switch 310 is connected to block 388 with wires 315 and 317. Momentary switch 312 is connected to block 388 with wires 319 and 321. Block 388 contains steering diodes responsive to contact closures on switches 310 and 312 that produce an enable signal on wire 384 connected to block 380 and a direction signal on wire 382 connected to block 376. Block 372 contains a digital address that is unique to block 308 in FIG. 2*e*, block 302 in FIG. 2*a*, and block 50 in FIG. 3. Block 372 provides the digital address on wire 374 which is connected to block 376. Block 376 encodes the digital address from block 372 and the direction signal from block 388. The encoded output of block 376 is connected by wire 378 to block 380. Block 380 is a wireless transmitter operating on frequency #1. Battery 386 provides +12 volts to the electrical elements of block 308.

In FIG. 2*f*, block 390 contains the elements of waterproof handheld key fob transmitter 390. Block 390 is designated to control the "TABS" functions of a boat. Momentary switch 402 is connected to block 452 with wires 403 and 405. Momentary switch 404 is connected to block 452 with wires 407 and 409. Block 452 contains steering diodes responsive to contact closures on switches 402 and 404 that produce an enable signal on wire 408 connected to block 400 and a direction signal on wire 406 connected to block 396. Block 392 contains a digital address that is unique to block 390 in FIG. 2*f*, block 306 in FIG. 2*b*, and block 61 in FIG. 3. Block 392 provides the digital address on wire 394 which is connected to block 396. Block 396 encodes the digital address from block 392 and the direction signal from block 452. The encoded output of block 396 is connected by wire 398 to block 400. Block 400 is a wireless transmitter operating on frequency #2. Battery 410 provides +12 volts to the electrical elements of block 390.

In FIG. 2*g*, block 444 contains the elements of waterproof handheld key fob transmitter 444. Block 444 is designated to control the "Lift" functions a marine propulsion unit. Momentary switch 470 is connected to block 448 with wires 471 and 473. Momentary switch 472 is connected to block 448 with wires 475 and 477. Block 448 contains steering diodes responsive to contact closures on switches 470 and 472 that produce an enable signal on wire 466 connected to block 462 and a direction signal on wire 464 connected to block 458. Block 454 contains a digital address that is unique to block 444 in FIG. 2*g*, block 330 in FIG. 2*c*, and block 55 in FIG. 3. Block 454 provides the digital address on wire 456, which is connected to block 458. Block 458 encodes the digital address from block 454 and the direction signal from block 448. The encoded output of block 458 is connected by wire 460 to block 462. Block 462 is a wireless transmitter operating on frequency #1. Battery 468 provides +12 volts to the electrical elements of block 440.

In FIG. 2*h*, block 474 contains the elements of waterproof handheld key fob transmitter 474. Block 474 is designated to control the "Audio" volume functions of a boat's audio system. Momentary switch 504 is connected to block 516 with wires 505 and 507. Momentary switch 506 is connected to block 516 with wires 509 and 511. Block 516 contains steering diodes responsive to contact closures on switches 504 and 506 that produce an enable signal on wire 512 connected to block 500 and a direction signal on wire 510 connected to block 498. Block 494 contains a digital address that is unique to block 474 in FIG. 2*h*, block 328 in FIG. 2*d*, and block 11 in FIG. 3. Block 494 provides the digital address on wire 496 that is connected to block 498. Block 498 encodes the digital address from block 494 and the direction signal from block 516. The encoded output of block 498 is connected by wire 502 to block 500. Block 500 is a wireless transmitter operating on frequency #2. Battery 514 provides +12 volts to the electrical elements of block 474.

Figure 3:
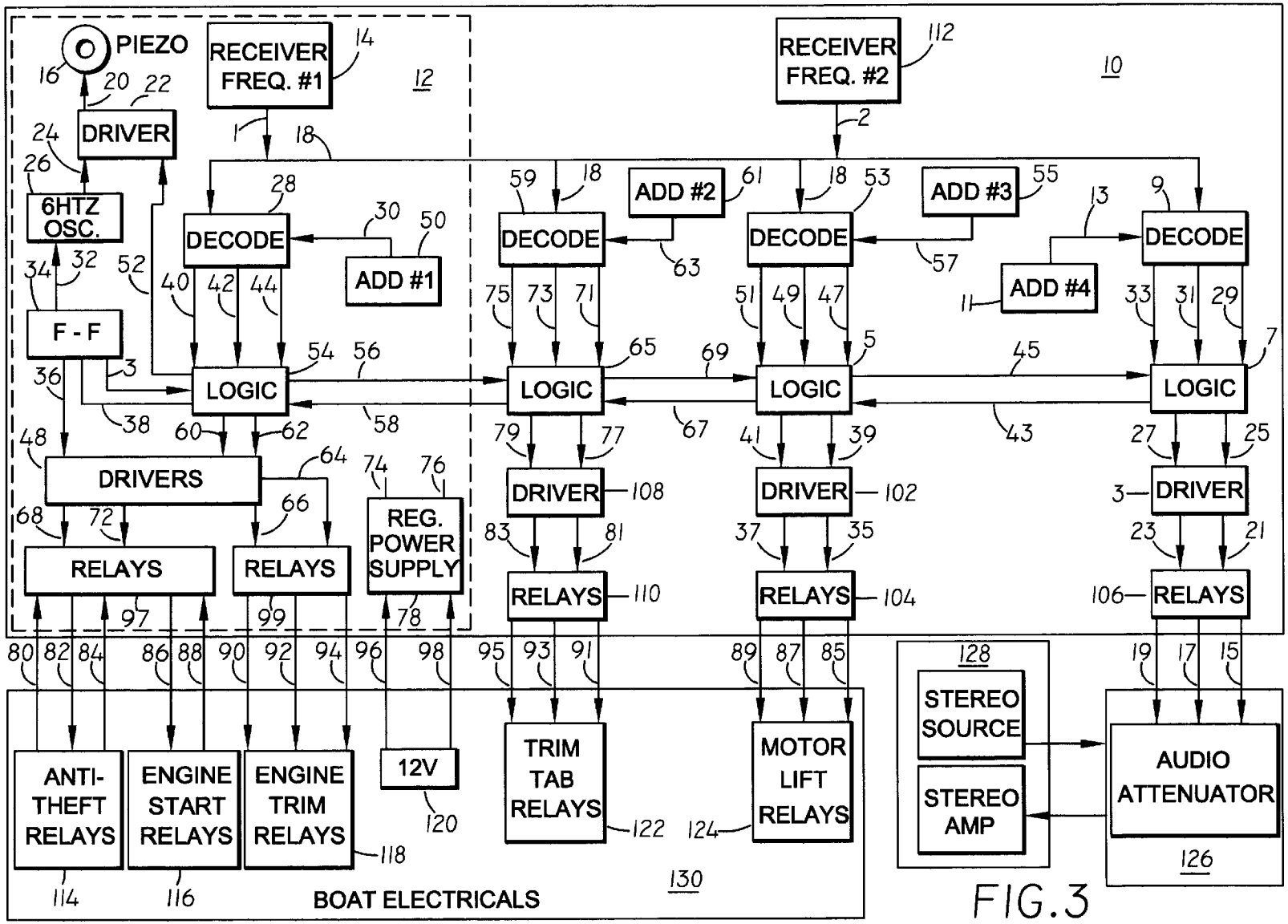
FIG. 3 is a block diagram showing the functional elements of the wireless remote receivers and control system taught by the present invention.

In FIG. 3, block 10 is an electrical block diagram of the wireless remote control system taught by the preferred embodiment of the present invention. It should be noticed that block 12 is functionally identical to my prior invention, U.S. Pat. Ser. No, 5,725,402 issued Mar. 10, 1998, except for the addition of blocks 26 and 22.

Block 14 contains a wireless receiver tuned to frequency #1. The output of block 14 is serial data and is connected by wire 1 to serial data bus 18. Block 112 contains a wireless receiver tuned to frequency #2. The output of block 112 is serial data and is connected by wire 2 to serial data bus 18. Serial data bus 18 connects to blocks 28, 59, 53, and 9 which are each serial data decoders. Block 28 connects to block 54 with wire 44, 42, and 40. Wire 44 is the UP output command of block 28. Wire 42 is the DOWN output command of block 28. Wire 40 is the VALIDATION output command of block 28. Block 54 contains digital AND, NAND, and OR logic that produces outputs on wires 52, 56, 38, 60, and 62. Wire 52 carries the VALIDATION command and is connected to block 22. Wire 56 carries the ENABLE/DISABLE command and is connected to block 65. Wires 60 and 62 are connected to block 48 and carry the DOWN and UP commands, respectively. Block 50 contains a digital address that is unique to block 12, block 308 in FIG. 2*e*, and block 302 in FIG. 2*a*. Block 50 is connected by wire 30 to block 28.

Block 34 contains a flip-flop with its output connected by wire 32 to block 26, wire 36 to block 48, and wire 3 to block 54. Block 34 toggles its output each time it receives and UP AND DOWN command on wire 38. Block 48 contains part of a ULN2003 relay driver integrated circuit that provides current gain. Block 48 is connected by wires 68 and 72 to block 97, and by wires 64 and 66 to block 99. Wires 68 and 72 both carry the SECURITY RELAY command. Wire 66 carries the TRIM RELAY UP command and wire 64 carries the TRIM RELAY DOWN command. Block 97 contains one SPST relay switch and one SPDT relay switch. Block 97 is connected by wires 80, 82, and 84 to block 114, and by wires 86 and 88 to block 116. Wires 80, 82, and 84 are respectively the normally closed, common, and normally open SPDT relay switch contacts of block 97. Wires 86, and 88 are respectively the common, and normally open SPST relay switch contacts of block 97. Block 114 represents an electrically actuated device onboard the boat, i.e., security alarm system, security illumination, engine ignition circuit. Block 116 represents the electrically actuated starting relay solenoid of a boat's engine. Block 99 contains two SPST relay switches and is connected by wires 90, 92, and 94 to block 118. Wires 90 carries the TRIM DOWN command. Wire 92 carries the TRIM COMMON command. Wire 94 carries the TRIM UP command. Block 118 represents the electrically actuated trim/tilt relay solenoid of a boat's propulsion unit.

Block 59 connects to block 65 with wire 75, 73, and 71. Wire 71 carries the UP output command from block 59. Wire 73 carries the DOWN output command from block 59. Wire 75 is the VALIDATION output command from block 59. Block 65 contains digital AND, NAND, and OR logic that produces outputs on wires 58, 69, 79, and 77. Wire 58 carries the VALIDATION command and is connected to block 54. Wire 69 carries the ENABLE/DISABLE command and is connected to block 5. Wire 79 carries the DOWN command and is connected to block 108. Wire 77 carries the UP command and is connected to block 108. Block 61 contains a digital address that is unique to block 50, block 306 in FIG. 2*b*, and block 390 in FIG. 2*f*. Block 61 is connected by wire 63 to block 59. Block 108 contains part of a ULN2003 relay driver integrated circuit that provides current gain. Block 108 is connected by wires 83 and 81 to block 110. Wire 81 carries the TABS RELAY UP command and wire 83 carries the TABS RELAY DOWN command. Block 110 contains two SPST relay switches and is connected by wires 95, 93, and 91 to block 122. Wire 95 carries the TABS DOWN command. Wire 93 carries the TABS COMMON command. Wire 91 carries the TABS UP command. Block 122 represents the electrically actuated trim tabs relay solenoid of a boat.

Block 53 connects to block 5 with wires 51, 49, and 47. Wire 47 carries the UP output command from block 53. Wire 49 carries the DOWN output command from block 53. Wire 51 is the VALIDATION output command from block 53. Block 5 contains digital AND, NAND, and OR logic that produces outputs on wires 67, 45, 41, and 39. Wire 67 carries the VALIDATION command and is connected to block 65. Wire 45 carries the ENABLE/DISABLE command and is connected to block 7. Wire 41 carries the DOWN command and is connected to block 102. Wire 39 carries the UP command and is connected to block 102. Block 55 contains a digital address that is unique to block 55, block 330 in FIG. 2*c*, and block 444 in FIG. 2*g*. Block 55 is connected by wire 57 to block 53. Block 102 contains part of a ULN2003 relay driver integrated circuit that provides current gain. Block 102 is connected by wires 37 and 35 to block 104. Wire 35 carries the LIFT RELAY UP command and wire 37 carries the LIFT RELAY DOWN command. Block 104 contains two SPST relay switches and is connected by wires 89, 87, and 85 to block 124. Wire 89 carries the LIFT DOWN command. Wire 87 carries the LIFT COMMON command. Wire 85 carries the LIFT UP command. Block 124 represents the electrically actuated elevation relay solenoid of the lifting device of a boat's propulsion unit.

Block 9 connects to block 7 with wires 33, 31, and 29. Wire 29 carries the UP output command from block 9. Wire 31 carries the DOWN output command from block 9. Wire 33 is the VALIDATION output command from block 9. Block 7 contains digital AND, NAND, and OR logic that produces outputs on wires 43, 27, and 25. Wire 43 carries the VALIDATION command and is connected to block 5. Wire 27 carries the DOWN command and is connected to block 3. Wire 25 carries the UP command and is connected to block 3. Block 11 contains a digital address that is unique to block 11, block 328 in FIG. 2*d*, and block 474 in FIG. 2*h*. Block 11 is connected by wire 13 to block 9. Block 3 contains part of a ULN2003 relay driver integrated circuit that provides current gain. Block 3 is connected by wires 23 and 21 to block 106. Wire 21 carries the LIFT RELAY UP command and wire 23 carries the LIFT RELAY DOWN command. Block 106 contains two SPST relay switches and is connected by wires 19, 17, and 15 to block 126. Wire 19 carries the AUDIO DOWN command. Wire 17 carries the AUDIO COMMON command. Wire 15 carries the AUDIO UP command. Block 126 represents the electrically actuated multi-channel audio attenuator of a boat's audio system.

Block 78 contains a 5 volt DC regulator integrated circuit and a filter circuit for 13.8 volts DC. Block 78 is connected by wires 96 and 98 to block 120. Wire 96 is electrical ground, and wire 98 is 13.8 volts DC. Block 120 represents the storage battery of the boat. Block 78 supplies 5 volts DC and 13.8 volts DC to wires 74 and 76, respectively. Wires 74 and 76 supply 5 volts DC and 13.8 volts DC to the electrical elements contained within block 10.

In FIG. 3, receiver 14 is tuned to frequency #1 and responds to transmitters 302, 330, 332, 338, in FIG. 1, and transmitters 308 and 444 in FIG. 2. Receiver 112 is tuned to frequency #2 and responds to transmitters 306, 326, 328, 336, in FIG. 1, and transmitters 390 and 474 in FIG. 2. The serial data output of receivers 14 and 112 is supplied by wire 18 simultaneously to decoders 28, 59, 53, and 9. Address block 50 provides decoder 28 with the same digital address (address #1) as transmitters 302, 332, and 308 in FIG. 1. Therefore, decoder 28 only produces outputs responsive to switch closures on transmitters 302, 332 and 308 which are designated as "TRIM" transmitters. Address block 61 provides decoder 59 with the same digital address (address #2) as transmitters 306, 326, and 390 in FIG. 1. Therefore, decoder 59 only produces outputs responsive to switch closures on transmitters 306, 326 and 390 which are designated as "TABS" transmitters. Address block 55 provides decoder 53 with the same digital address (address #3) as transmitters 330, 338, and 444 in FIG. 1. Therefore, decoder 53 only produces outputs responsive to switch closures on transmitters 330, 338 and 444 which are designated as "LIFT" transmitters. Address block 11 provides decoder 9 with the same digital address (address #4) as transmitters 328, 336, and 474 in FIG. 1. Therefore, decoder 9 only produces outputs responsive to switch closures on transmitters 328, 336 and 474 which are designated as "AUDIO" transmitters.

The outputs produced by decoder 28 are UP, DOWN, and VALIDATION on wires 44, 42, and 40, respectively. These commands are supplied to block 54 wherein logic gates process the UP, DOWN, and VALIDATION commands and synthesize another command, UP AND DOWN. The synthesis of the UP AND DOWN command by control logic block 54 occurs exclusively as a result of the simultaneous activation of momentary push button switches 310 and 312 on key fob "Trim" transmitter 308. Even though transmitters 302 and 332 operate on the same frequency as transmitter 308 and contain identical digital addressing, rocker switches 304 and 346 prohibit simultaneous UP and DOWN commands. Block 54 supplies the UP AND DOWN command to block 34 on wire 38. Block 34 contains a flip-flop integrated circuit that toggles its output state each time it receives the UP AND DOWN command from block 54 and produces the command ENABLE/DISABLE. The ENABLE/DISABLE command output of block 34 is connected to block 54 by wire 3 and serves to place the control logic of block 54 in an enabled state when wire 3 is at a logic-1 level and a disabled state when wire 3 is at a logic-0 level. The ENABLE/DISABLE command state is outputted from block 54 by wire 56 to the control logic block 65, from block 65 by wire 69 to block 5, and from block 5 by wire 45 to block 7. This configuration allows block 34 to enable all of the control logic blocks contained in block 10 of FIG. 1 when the ENABLE/DISABLE command is set to logic-1 level, and disable all of the control logic blocks when the command is set to a logic-0 level. When control logic block 54 is enabled, it outputs the UP and DOWN commands on wires 62 and 60 respectively, responsive to switch closures on "TRIM" transmitters 308, 302, and 332. When block 65 is disabled, its only output responsive to switch closures on the "TABS" transmitters, is the VALIDATATION command on wire 52. Wire 52 connects to block 22 where a drive signal responsive to the logic-1 level of the VALIDATION command produces a dive signal for piezo transducer 16. Wires 62 and 60 are connected to relay driver block 48 which provides the outputs on wires 66 and 64 to block 99. Block 99 contains 2 SPST relay switches. One SPST relay switch connects to wire 66 and activates when an UP switch is pressed on a "Trim" transmitter. The remaining SPST relay switch is connected to wire 64 and activates when a DOWN switch is pressed on a "Trim" transmitter. The common poles of both SPST relay switches are joined and connect to wire 92, the TRIM COMMON command wire. The normally open contact of the relay switch connected to wire 66 is connected to wire 94 and provides the TRIM RELAY UP command wire. The normally open contact of the relay switch connected to wire 64 is connected to wire 90 and provides the TRIM RELAY DOWN command wire. Wires 90, 92 and 94, are connected to the boat's trim/tilt solenoids represented by block 118.

Block 34 outputs the ENABLE/DISABLE command on wire 36 to block 48. Block 48 contains relay drivers that output the SECURITY RELAY command on wires 68 and 72. Wires 68 and 72 connect to block 97 which contains a SPST and a SPDT relay switch. When the ENABLE/DISABLE command is set to a logic level-1, the SPDT relay in block 97 activates and provides a circuit path between wires 82 and 84. When the ENABLE/DISABLE command is set to a logic-0 level, the SPDT relay deactivates and provides a circuit path between wires 82 and 80. Likewise, when the ENABLE/DISABLE command is set to a logic-1 level, the SPST relay in block 97 activates and provides a circuit path between wires 86 and 88. When the ENABLE/DISABLE command is set to a logic-0 level, the SPDT relay deactivates and opens a circuit path between wires 86 and 88. Wires 80, 82, and 84 are connected to block 114 which represents any device onboard a boat requiring remote control, i.e., security system, security illumination, engine ignition, audio system. Wires 86 and 88 connect to block 116 which represents the starting solenoid of a marine propulsion unit.

The output of block 34 connects by wire 32 to block 26. Block 26 contains a one second duration one-shot circuit and a 6 Htz square wave generator. Each time wire 32 transitions from a logic-0 to a logic-1 level, block 26 produces a 6 pulse square wave output on wire 24. Wire 24 connects to block 22, a piezo driver that provides a drive signal to block 16 on wire 20. The piezo transducer provides audio annunciation of the state of operation of the present invention.

The outputs produced by decoder 59 are UP, DOWN, and VALIDATION on wires 71, 73, and 75, respectively. These commands are supplied to block 65 wherein logic gates process the UP, DOWN, and VALIDATION commands. The ENABLE/DISABLE command output of block 54 is connected to block 65 by wire 56 and serves to place the control logic of block 65 in an enabled state when wire 56 is at a logic-1 level and a disabled state when wire 56 is at a logic-0 level. When control logic block 65 is enabled, it outputs the UP and DOWN commands on wires 77 and 79 respectively, responsive to switch closures on "TABS" transmitters 326, 306, and 390. When block 65 is disabled, its only output responsive to switch closures on the "TABS" transmitters, is the VALIDATATION command on wire 58. Wire 58 connects to block 54 wherein the VALIDATION command produced by block 56 it is combined (logical OR) with the VALIDATION command produced by block 54. Wires 77 and 79 are connected to relay driver block 108 which provides outputs on wires 81 and 83 to block 110. Block 110 contains 2 SPST relay switches. One SPST relay switch connects to wire 81 and activates when an UP switch is pressed on a "TABS" transmitter. The remaining SPST relay switch is connected to wire 83 and activates when a DOWN switch is pressed on a "TABS" transmitter. The common poles of both SPST relay switches are joined and connect to wire 93, the TABS RELAY COMMON command wire. The normally open contact of the relay switch connected to wire 81 is connected to wire 91 and provides the TABS RELAY UP command wire. The normally open contact of the relay switch connected to wire 83 is connected to wire 95 and provides the TABS RELAY DOWN command wire. Wires 95, 93 and 91, are connected to the boat's trim tabs solenoids represented by block 122.

The outputs produced by decoder 53 are UP, DOWN, and VALIDATION on wires 47, 49, and 51, respectively. These commands are supplied to block 5 wherein logic gates process the UP, DOWN, and VALIDATION commands. The ENABLE/DISABLE command output of block 65 is connected to block 5 by wire 69 and serves to place the control logic of block 5 in an enabled state when wire 69 is at a logic-1 level and a disabled state when wire 69 is at a logic-0 level. When control logic block 5 is enabled, it outputs the UP and DOWN commands on wires 39 and 41 respectively, responsive to switch closures on "LIFT" transmitters 330, 338, and 444. When block 5 is disabled, its only output responsive to switch closures on the "LIFT" transmitters, is the VALIDATATION command on wire 67. Wire 67 connects to block 65 wherein The VALIDATION command produced by block 5 it is combined (logical OR) with the VALIDATION command produced by block 65. Wires 39 and 41 are connected to relay driver block 102 which provides outputs on wires 35 and 37 to block 104. Block 104 contains 2 SPST relay switches. One SPST relay switch connects to wire 35 and activates when an UP switch is pressed on a "LIFT" transmitter. The remaining SPST relay switch is connected to wire 37 and activates when a DOWN switch is pressed on a "LIFT" transmitter. The common poles of both SPST relay switches are joined and connect to wire 87, the LIFT RELAY COMMON command wire. The normally open contact of the relay switch connected to wire 35 is connected to wire 85 and provides the LIFT RELAY UP command wire. The normally open contact of the relay switch connected to wire 37 is connected to wire 89 and provides the LIFT RELAY DOWN command wire. Wires 89, 87 and 85, are connected to the boat's engine lift solenoids represented by block 124.

The outputs produced by decoder 9 are UP, DOWN, and VALIDATION on wires 29, 31, and 33, respectively. These commands are supplied to block 7 wherein logic gates process the UP, DOWN, and VALIDATION commands. The ENABLE/DISABLE command output of block 7 is connected to block 5 by wire 43 and serves to place the control logic of block 7 in an enabled state when wire 43 is at a logic-1 level and a disabled state when wire 45 is at a logic-0 level. When control logic block 7 is enabled, it outputs the UP and DOWN commands on wires 25 and 27 respectively, responsive to switch closures on "AUDIO" transmitters 328, 336, and 474. When block 7 is disabled, its only output responsive to switch closures on the "AUDIO" transmitters, is the VALIDATATION command on wire 43. Wire 43 connects to block 5 wherein The VALIDATION command produced by block 7 it is combined (logical OR) with the VALIDATION command produced by block 5. Wires 25 and 27 are connected to relay driver block 3 which provides outputs on wires 21 and 23 to block 106. Block 106 contains two SPST relay switches. One SPST relay switch connects to wire 21 and activates when an UP switch is pressed on an "AUDIO" transmitter. The remaining SPST relay switch is connected to wire 23 and activates when a DOWN switch is pressed on an "AUDIO" transmitter. The common poles of both SPST relay switches are joined and connect to wire 17, the AUDIO RELAY COMMON command wire. The normally open contact of the relay switch connected to wire 21 is connected to wire 15 and provides the AUDIO RELAY UP command wire. The normally open contact of the relay switch connected to wire 23 is connected to wire 19 and provides the AUDIO RELAY DOWN command wire. Wires 19, 17 and 15, are connected to the boat's multi-channel audio attenuator represented by block 126.

Figure 4:
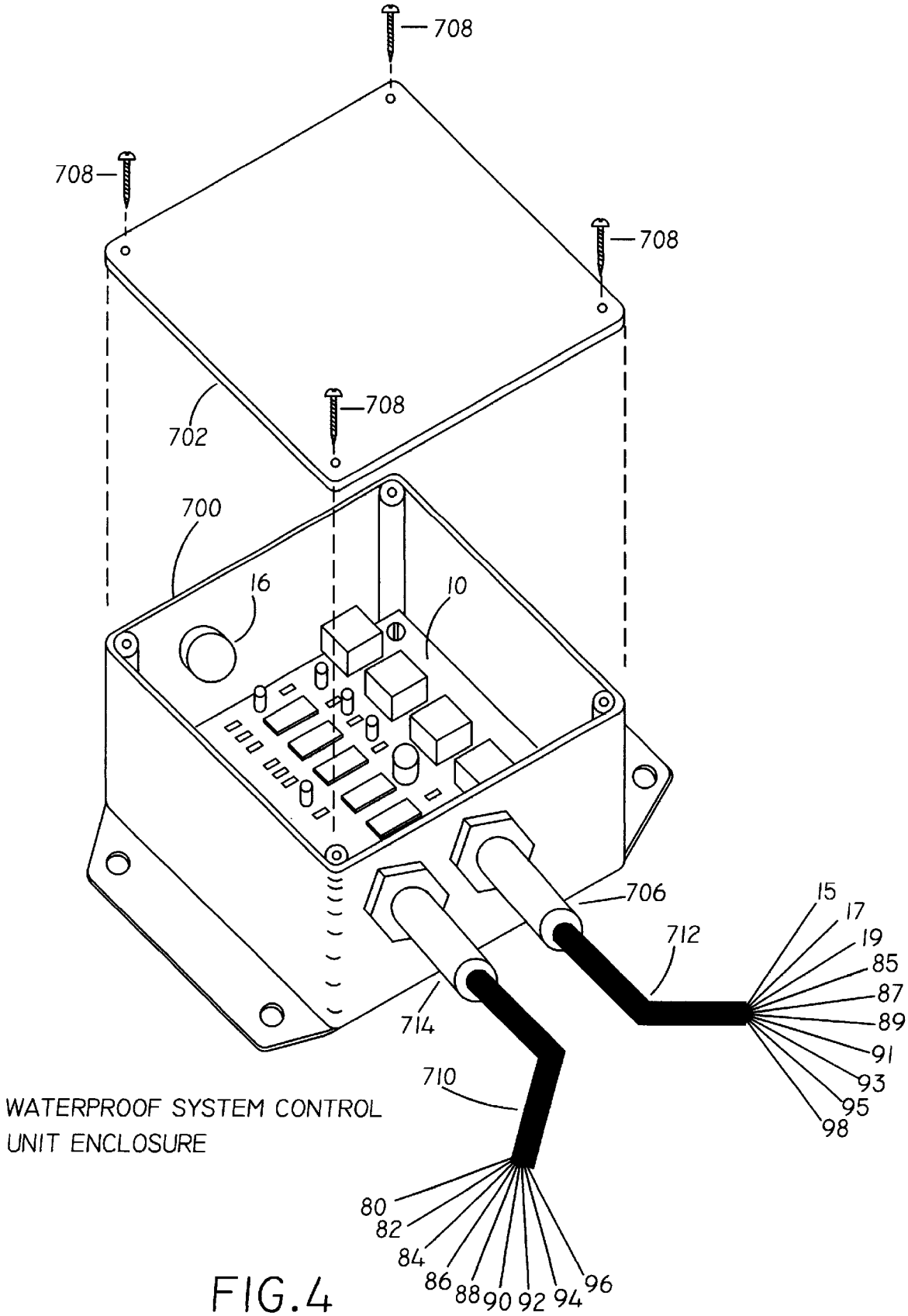
FIG. 4 is an exploded perspective view of the receivers and control system, the waterproof enclosure, and the electrical outputs of the invention.

In FIG. 4, functional block 10 is disposed inside a waterproof plastic case 700, with output cable bundles 710 and 712 exiting the case through hermetic seals 714 and 706, respectively. The individual input and output wires are labeled for identification.

The system control unit shown in FIGS. 3 and 4 is mounted in any convenient place inside the boat such as under the dashboard, or engine compartment. The wiring harness is connected as shown in FIG. 4. The transmitters are then attached to the steering wheel of the boat. The handheld key fob transmitters are complete as supplied and require no installation.

To operate the invention, enable the system control unit by simultaneously pressing both the UP and DOWN switches on the handheld "Trim" key fob transmitter. This will cause six "beeps" to be omitted from the system control unit, both security relays will activate and devices connected through the security relays will be active. To move the propulsion unit, push the UP or DOWN switch on any "Trim" transmitter. To operate the other control system functions, i.e., "Tabs" , Lift", "Audio", simply push the UP or DOWN switch on the corresponding steering wheel or handheld key fob transmitter. To disable the invention, simultaneously press both the UP and DOWN switches on the handheld "Trim" key fob transmitter. This will cause a single "beep" to be omitted, both security relays will deactivate, and all UP and DOWN control functions will disable. Subsequent pressing of the UP or DOWN switches on any transmitters will produce "beeps" from the system control unit responsive to the switch closures on the transmitters but all UP and DOWN relay switch activation is disabled.

Although this specification has disclosed the best embodiment known to the inventor of practicing the present invention, it should not be read as limiting the invention. The invention should be limited only by the appended claims and their equivalents.

What is claimed is:

1. A control apparatus for remotely controlling relay actuated, electrically controlled systems of a boat comprising:

a first wireless transmitter means operating on a first frequency and a second wireless transmitter means operating on a second frequency, said first wireless transmitter means having a first control means for selectively producing a first wireless signal said first frequency in response to an external command and a second control means for producing a second wireless signal on said first frequency in response to an external command, said second wireless transmitter means having a first control means for selectively producing a first wireless signal on said second frequency and a second control means for selectively producing a second wireless signal on said second frequency in response to an external command;

a first receiver means operating on said first frequency for detecting said first and said second wireless signals on said first frequency and a second receiver means operating on said second frequency for detecting said first and said second wireless signals on said second frequency;

decoding and logic means responsive to said first receiver means and responsive to said second receiver means for simultaneously producing a plurality of electrical outputs, each electrical output being produced by the detection of said first and said second wireless signals on said first and said second frequencies and by the detection of the simultaneous combination of said first and said second wireless signals on said first and said second frequencies; and a relay means responsive to the plurality of electrical outputs of the decoding and logic means for controlling the flow of electric power to said electrically controlled systems.

2. An apparatus as in claim 1, including switching means responsive to said plurality of electrical outputs for locking the state of said plurality of relays.

3. An apparatus as in claim 2 wherein the first transmitter means is affixed to the boat and the second transmitter means is not affixed to the boat.

4. An apparatus as in claim 3 wherein the transmitter means affixed to the boat uses a rocker switch for its first and second control means.

* * * * *